US010247506B1

(12) United States Patent
Armstrong et al.

(10) Patent No.: US 10,247,506 B1
(45) Date of Patent: Apr. 2, 2019

(54) INDIRECT FIRE MISSION TRAINING SYSTEM—ARTILLERY AMMUNITION MANAGEMENT

(71) Applicant: Cubic Corporation, San Diego, CA (US)

(72) Inventors: Martyn Armstrong, Salisbury (GB); Neale Smiles, Salisbury (GB); Alastair Parkinson, Wilton (GB); David Boissel, Salisbury (GB); George Sparshatt-Potter, Pewsey (GB)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/148,156

(22) Filed: Oct. 1, 2018

Related U.S. Application Data

(60) Provisional application No. 62/565,904, filed on Sep. 29, 2017.

(51) Int. Cl.
*F41A 33/00* (2006.01)
*F41A 9/42* (2006.01)
*F42B 8/08* (2006.01)

(52) U.S. Cl.
CPC ..... *F41A 33/00* (2013.01); *F41A 9/42* (2013.01); *F42B 8/08* (2013.01)

(58) Field of Classification Search
CPC ..... F41A 33/00; F41A 33/02; F41A 33/04; F41A 33/06; F41A 33/08; F41A 9/42; F42B 8/00; F42B 8/02; F42B 8/08; F42B 8/12; F42B 8/14; F42B 8/20; F42B 8/24
See application file for complete search history.

(56) References Cited

U.S. PATENT DOCUMENTS 2,786,415 A * 3/1957 Alderson ..... F41A 33/00 102/445
8,127,685 B2 * 3/2012 O'Dwyer ..... F42B 5/035 102/438
2005/0268807 A1 * 12/2005 Bambach ..... F42B 5/035 102/438

* cited by examiner

*Primary Examiner* — Timothy A Musselman
(74) *Attorney, Agent, or Firm* — Kilpatrick Townsend & Stockton LLP

(57) ABSTRACT

An indirect fire mission training round includes a projectile training shell having an outer periphery, a proximal end, and a distal end, the proximal end defining an interior chamber. The projectile training shell is configured to be inserted within a cavity of a projectile firing instrument. The round includes an interlock member configured to securely receive a proximal portion of a subsequent training round within the interior chamber of the projectile training shell. The round includes a resistance brake extending outward from the outer periphery and configured to contact a wall of the cavity of the firing instrument and provide resistance that secures the projectile training shell at a position within the cavity. The resistance break is selectively disengageable such that the position of the projectile training shell is adjustable.

20 Claims, 8 Drawing Sheets

INDIRECT FIRE MISSION TRAINING SYSTEM—ARTILLERY AMMUNITION MANAGEMENT

CROSS-REFERENCES TO RELATED APPLICATIONS

This application claims the benefit of U.S. Provisional Application No. 62/565,904, entitled "INDIRECT FIRE MISSION TRAINING SYSTEM—ARTILLERY AMMUNITION MANAGEMENT," filed on Sep. 29, 2017, the entire contents of which is hereby incorporated by reference.

BACKGROUND OF THE INVENTION

The use of live ammunition when training users (e.g., an artillery crew) how to use indirect-fire weapons can be quite costly, and classroom training can be insufficient in that it may not enable user to train in tactical applications of indirect fire. Traditional indirect-fire training systems have therefore tried to address these issues by using a physical training system in which simulated ammunition is used. But new problems may arise in the use of simulated ammunition. One of the key considerations in designing a successful indirect fire mission training system is therefore management of this simulated artillery ammunition.

A fundamental design principle of an indirect fire mission training system is that they should not introduce a false training drill. Given that live artillery is expended through firing, a "dry" (simulated) training system should therefore overcome the issue of what to do with a simulated round typically derived from a real round with explosives and driving bands removed). Removal of a simulated round from the breech of an indirect firing weapon constitutes a false drill (introducing an additional step that is not taken during live firing), whilst ejecting the ammunition from the end of the barrel necessitates a propellant mechanism, introduces a danger area to the front of the artillery system, and may be costly.

BRIEF SUMMARY OF THE INVENTION

Embodiments of the present invention are directed to weapons training systems that allow users to realistically simulate the repeated loading and firing of artillery weapons system, without introducing false drills. This enables users to practice real-time weapons simulations in a cost effective, repeatable, and safe manner. Embodiments of the invention achieve the desired results by utilizing dummy ammunition rounds that are configured to nest within one another within a breach or barrel of a weapon, such that several firings may be practiced in a sequence without the need to remove the previous projectile round/shell. The projectile rounds include disengageable brake mechanisms that maintain the rounds within the breach of the weapon after insertion and are only removable upon a user actively disengaging the brake mechanisms to reset the drill.

In one embodiment, an indirect fire mission training round is provided. The round may include a projectile training shell having an outer periphery, a proximal end, and a distal end. The proximal end may define an interior chamber and the projectile training shell may be configured to be inserted within a cavity of a projectile firing instrument. The round may also include an interlock member configured to securely receive a proximal portion of a subsequent training round within the interior chamber of the projectile training shell and a resistance brake extending outward from the outer periphery and configured to contact a wall of the cavity of the firing instrument and provide resistance that secures the projectile training shell at a position within the cavity. The resistance brake may be selectively disengageable such that the position of the projectile training shell is adjustable.

In another embodiment, an indirect fire mission training system is provided. The system may include a weapon firing instrument having a body defining a projectile cavity and a plurality of indirect firing rounds that are configured to be loaded into the projectile cavity in a nested manner. Each of the plurality of indirect firing training rounds may include an outer periphery, a proximal end, and a distal end. The proximal end may define an interior chamber. Each round may also include an interlock member configured to securely receive a proximal portion of a subsequent training round within the interior chamber of the projectile training shell and a resistance brake extending outward from the outer periphery and configured to contact a wall of the projectile cavity of the weapon firing instrument and provide resistance that secures the projectile training shell at a position within the projectile cavity. The resistance brake may be selectively disengageable such that the position of the projectile training shell is adjustable.

In another embodiment, a method of operating an indirect fire mission training system is provided. The method may include inserting a first indirect firing round into a projectile cavity defined within a body of a weapon firing instrument such that a resistance brake of the first indirect firing round engages an inner wall of the projectile cavity and provides resistance that secures the projectile training shell at a position within the projectile cavity. The method may also include inserting a second indirect firing round into the projectile cavity such that a distal end of the second indirect firing round nests within an interior chamber of the first indirect firing round and engages an interlock member of the first indirect firing round to disengage the resistance brake of the first indirect firing round. The method may further include moving both the first indirect firing round and the second indirect firing round deeper within the projectile cavity and engaging the resistance brake of the first indirect firing round with the inner wall and engaging a resistance brake of the second indirect firing round with the inner wall.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1:
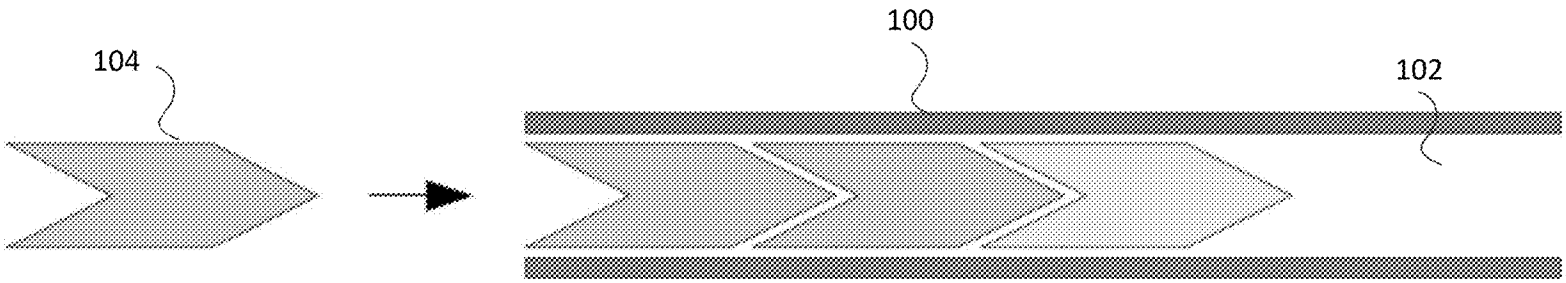
FIG. 1 is a simplified schematic of simulated rounds being loaded into a cavity of an indirect fire weapon instrument according to embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention described herein are generally related to a training system for indirect-fire instrument (e.g., mortars, howitzers, missiles, grenade launchers, and other weapons, including direct-fire instrument (e.g., general-purpose machine guns) operating in indirect-fire mode). It will be appreciated that other applications may be contemplated.

Embodiments described herein are directed to live fire training systems that store rounds in the barrel of the artillery piece through the use of a brake mechanism and a mechanism for interlocking the rounds/shells in order to allow several live fire drills to be conducted in a row without removing the last shell before proceeding with each additional simulation. Upon completion of a series of dry firing simulations, an unloading tool is provided that allows the rounds to be extracted from the breech and/or barrel of the weapon. Some embodiments include a mechanism for stopping mechanically-loaded rounds from being ejected through the barrel when a mechanically-operated loading system is employed. More specifically, embodiments provide for the use of simulated artillery shells that can be loaded into the breach, stacked into the barrel via a locking mechanism, then extracted for reuse. In some embodiments, pneumatic force can be used to slow down and stop mechanically rammed artillery shells.

Embodiments can use a lightweight simulated ("dummy") artillery shell that can be interlocked with others. In some embodiments, a tensioned rubber driving band may be used to hold the round in the barrel, at any angle, until released. Embodiments of the invention enable simulated ammunition to be loaded into and stored within the barrel of a firing instrument during a training exercise, for example. In some embodiments, a barrel plug with event may be used to help slow and stop a round before the round reaches the end of the barrel. Additionally or alternatively, embodiments may include a venting mechanism to allow rounds to be stacked together through the venting of air trapped between loaded rounds. Optionally, a barrel plug with a valve may be used. The valve can allow air trapped between the plug and a loaded round to be vented in a controlled manner to slow and then stop mechanically-loaded rounds.

By using some or all of the features described herein, training systems are provided that allow an artillery (or other device) crew to conduct multiple dry firings without employing a false drill that requires the removal of round from the barrel/cavity of the firing instrument. Training can be stopped at an appropriate time by an instructor for a reset, at which time rounds that were inserted into the cavity can be extracted from either the breech or muzzle as appropriate to the particular application. In some embodiments, the training round may be constructed of a material that is softer than the barrel such that no damage with be incurred through repeated use.

In some embodiments, the braking mechanism can provide for sufficient friction and inertia for the loader to have to exert an amount of force that is the same, or similar, as done in a real firing of the weapon. The locking mechanism may be sufficiently robust so as to hold the dummy rounds in the barrel to any elevation safely, without the danger of the rounds sliding backwards out of the breech (if open).

Turning now to FIG. 1, a simplified schematic of simulated rounds ("parts") being loaded into a cavity 102 of an indirect-fire weapon firing instrument 100 is illustrated. Weapon firing instrument 100 may be any type of weapon that is configured to eject a projectile through a breach and/or barrel of the weapon firing instrument 100. For example, weapon firing instrument 100 may include mortars, howitzers, missiles, grenade launchers, and/or other weapons, including direct-fire weapons (e.g., general-purpose machine guns) operating in indirect-fire mode). Cavity 102 is configured to receive one or more projectile rounds or shells 104 and may include or be a barrel and/or breach, depending on the relevant weapon firing instrument 100. Here, one or more self-braking shells 104 may be needed to be inserted into the cavity to perform a function or task (e.g., simulate the loading of the indirect-fire weapon during artillery training). The shells 104 may be configured to at least partially nest within one another such that a nose of one shell 104 may be received within an inner chamber defined by the body of a previously inserted shell 104. In some embodiments, only the nose (or a portion thereof) of each shell 104 may be received within a particular chamber, while in other embodiments a rear section (or portion thereof) may also be received within the chamber.

Shells 104 may be self-braking by including a resistance brake that may create a resistance force relative to the inner wall of the cavity 102, thereby enabling the shells 104 to stop at and maintain a desired position within the cavity 102 such that weapon firing instrument 100 may be moved into any orientation without any shells 104 housed within the cavity 102 falling out of the cavity 102 and/or otherwise moving within the cavity 102. Oftentimes, the resistance brake may apply friction force against the wall of the cavity 102, although other types of force, such as magnetic force may be used in some embodiments. The resistance brake may be disengaged by the user to allow the shells 104 to be moved within the cavity 102 and/or removed from the cavity 102 through a breach and/or barrel of the weapon firing instrument 100. Shells 104 can offer a physical connection to each other in a "daisy-chain" manner for easy removal such as described in greater detail in relation to the following figures.

Figure 2:
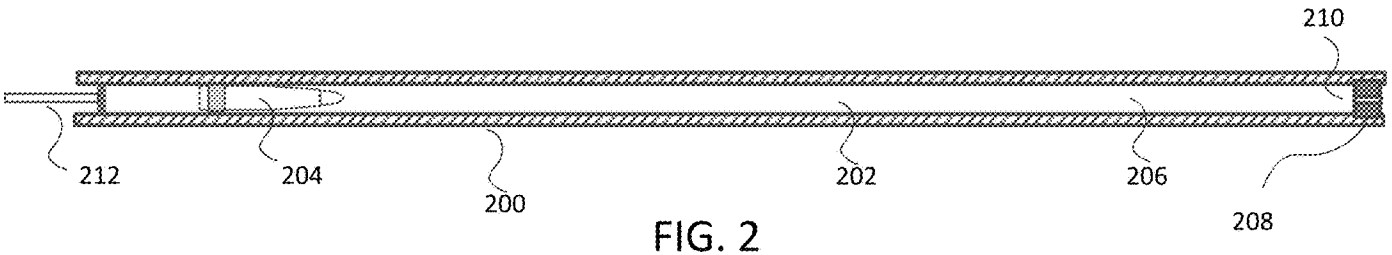
FIG. 2 depicts a weapon firing instrument according to embodiments.
Figure 3A:
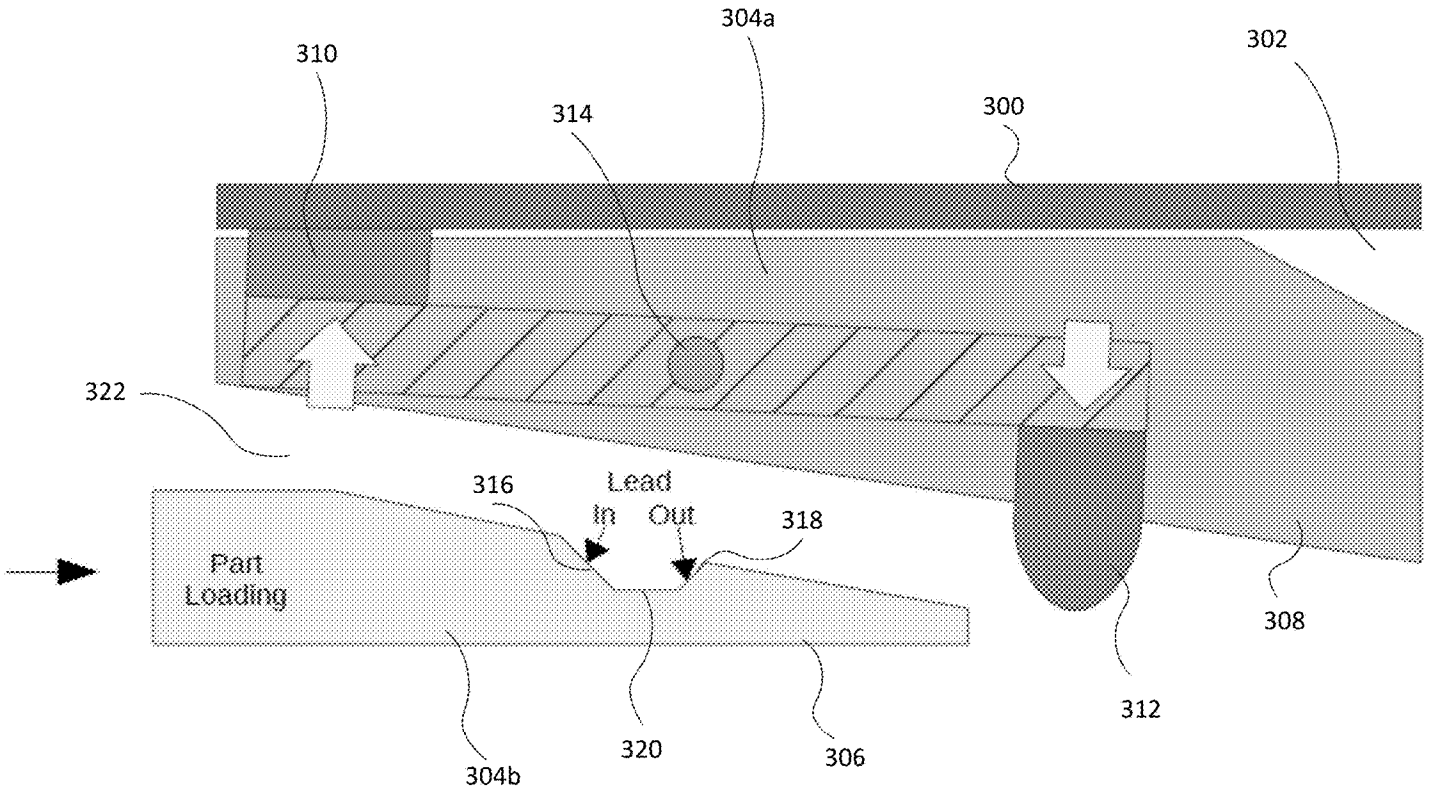
FIG. 3A depicts an indirect weapon firing system in an at rest configuration according to embodiments.
Figure 3B:
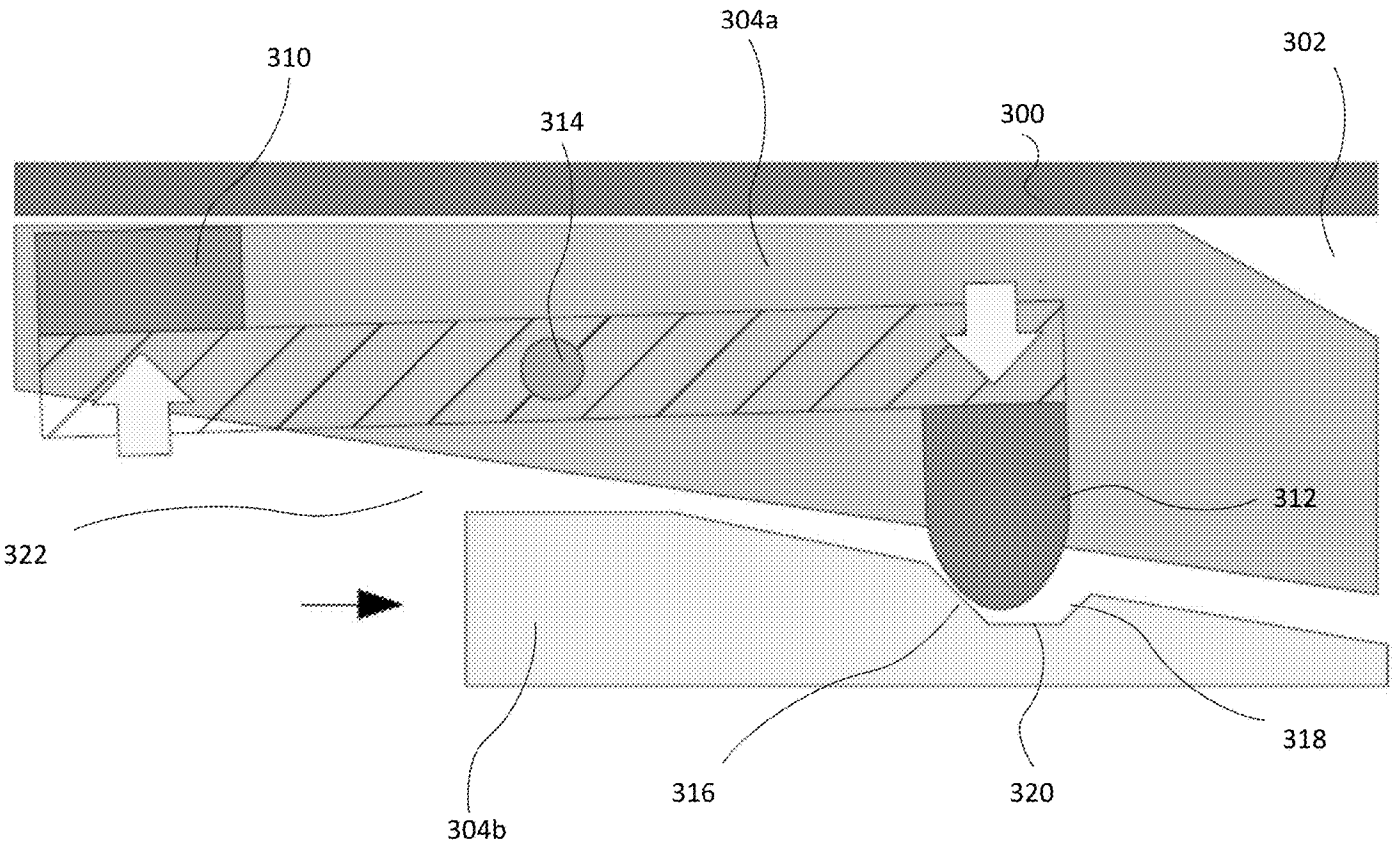
FIG. 3B depicts an indirect weapon firing system in an in motion configuration according to embodiments.
Figure 3C:
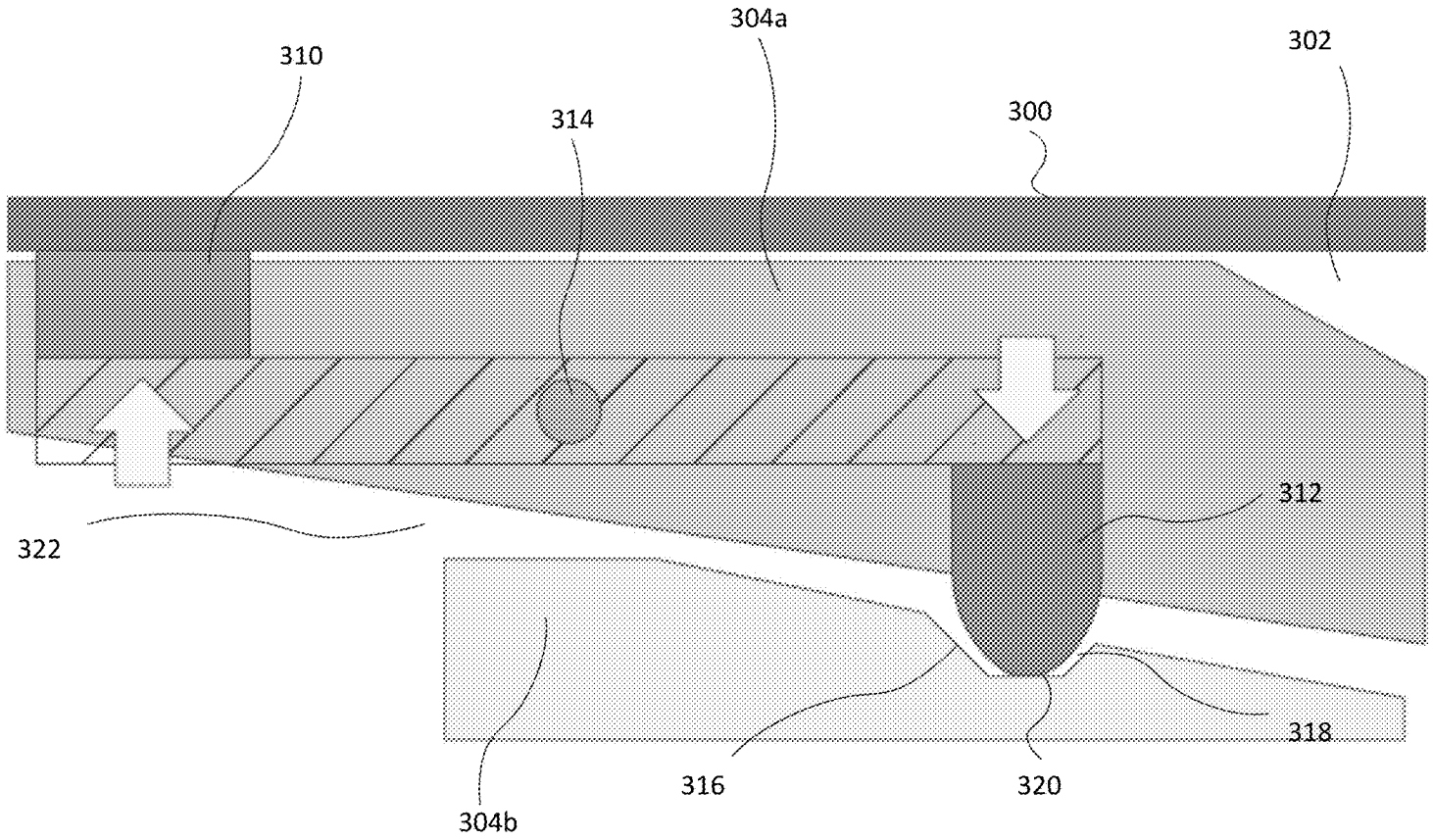
FIG. 3C depicts an indirect weapon firing system in an engaged configuration according to embodiments.
Figure 3D:
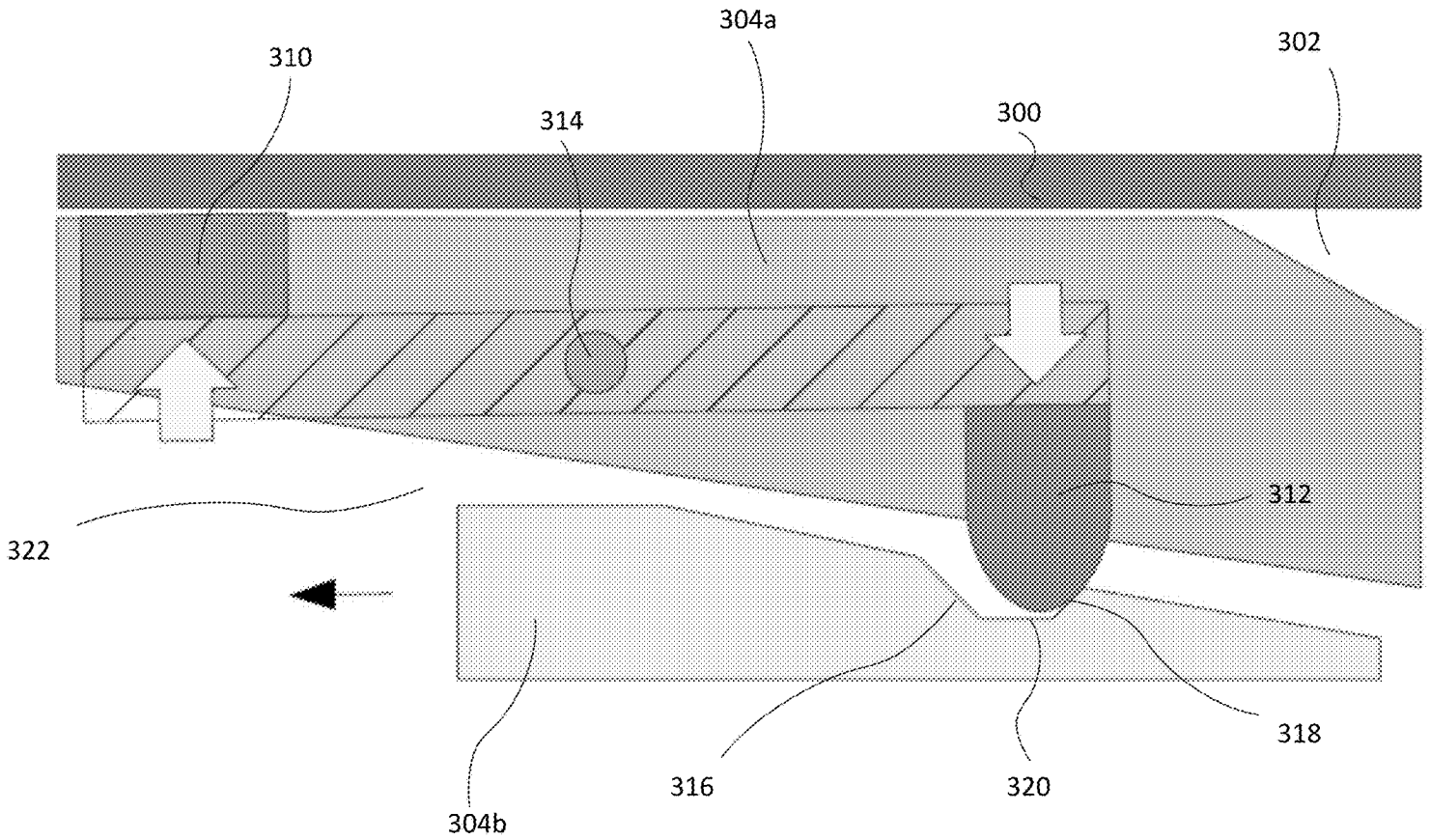
FIG. 3D depicts an indirect weapon firing system in an in motion configuration according to embodiments.

FIGS. 2-3D depict a closer view of the cavity of a weapon and simulated round(s) or shells positioned therein. In particular, FIG. 2 depicts one embodiment of a weapon firing instrument 200 for firing projectiles. Weapon firing instrument 200 may be the same or similar to weapon firing instrument 100 and may include a body that defines a projectile cavity 202. Cavity 202 is configured to receive one or more projectile rounds or shells 204 and may include or be a barrel and/or breach, depending on the relevant weapon firing instrument 200. As illustrated here, the weapon firing instrument 200 is configured to eject the projectile shells 204 out of a barrel 206 in live fire scenarios. When used in dry fire training sessions, the weapon firing instrument 200 may be fitted with a barrel plug 208 that may serve as a stop for the shell 204 and/or may prevent the shell 204 from exiting through the barrel. The barrel plug 208 may be configured to cover all or part of the ejection opening of the barrel, and may be secured to the weapon firing instrument 200 in any number of manner. For example, all or part of the barrel plug 208 may be sized to be friction, snap, and/or compression fit within the barrel to secure the barrel plug 208 in the desired position. It will be appreciated that other coupling techniques may be used in addition to (or alternatively to) the friction, snap, and/or compression fit. For example, magnetic coupling, fasteners, clamps, and/or other coupling mechanisms may be utilized. The barrel plug 208 may be removably secured to the weapon firing instrument 200 such that removal of the barrel plug 208 may be done to enable live firing exercises and/or other live firing usage.

In some embodiments, the barrel plug 208 may define at least one ventilation opening 210. Ventilation opening(s) 210 may be positioned anywhere on the barrel plug 208 and provide pathways for air to escape the projectile cavity 202 as shells 204 are loaded and pushed into the cavity 202. Such designs allow any air trapped and compressed between the shells 204 and the barrel plug 208 to be vented in a controlled manner, which may serve to slow and stop the shell 204 before it reaches the end of the barrel and prevents the pressure of the trapped air from increasing to a level that could cause the shell 204 to be ejected from the breach of the weapon firing instrument 200 or that could cause the barrel plug 208 and/or shell 204 to be ejected from the barrel of the weapon firing instrument 200. In some embodiments, rather than having a plain opening, the barrel plug 208 may include one or more valves that are configured to open and release air upon a certain air pressure being reached within the cavity 202 of the weapon. For example, check valves and other one-way valves that allow air to exit the from the cavity 202 but not enter the cavity 202 may be utilized to control air pressure within the cavity 202.

An insertion tool 212 may be used to load the shells 204 into the cavity 202. For example, a flick rammer and/or other ram or loading device may be used to apply pressure to one end of the shells 204 to urge the shells 204 (one at a time) into the cavity 202. For example, in embodiments in which weapon firing instrument 200 is configured to eject projectile rounds from a barrel, the insertion tool 212 may be configured to contact a butt of each shell 204 to press the shell 204 into the cavity 202 and into the barrel. In embodiments where a weapon ejects a projectile round from its breach (such as mortars), the insertion tool 212 may be configured to contact a nose of the shell 204 to pressure the shell 204 into the cavity 202 and into the breach.

Figure 2A:
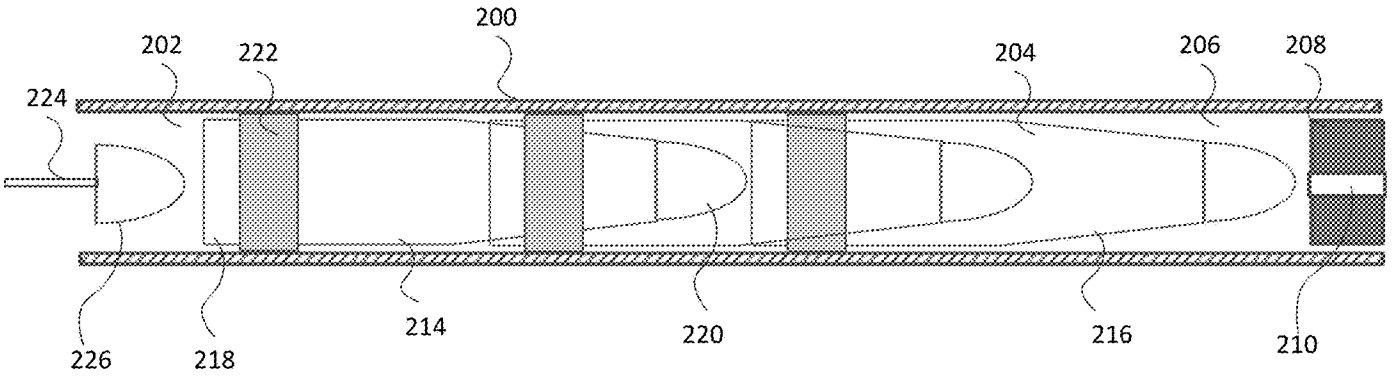
FIG. 2A depicts several shells loaded into the cavity of the weapon firing instrument of FIG. 2.

FIG. 2A depicts several shells 204 loaded within cavity 202. The shells may be accumulated within the cavity 202 in a nested manner, such as how shuttlecocks are stored in a tube. To facilitate such an arrangement, each shell 204 may include a body 214 that includes a nose 216 and a butt 218. The nose 216 is smaller than the butt 218 and may be tapered in some embodiments, resembling a bullet or missile-shaped profiled. The body 214 may define an interior chamber (not shown) in which at least a portion of the nose 216 and/or the butt 218 of another shell 204 may be received. The chamber may be sized and shaped to receive the another shell 204 (or portion thereof) and engage at least a portion of the outer periphery of the another shell 204 such that a series of shells 204 may be nested in a daisy-chain arrangement in a uniform fashion. Each of the shells 204 may include an engagement mechanism that allows one shell 204 to be cured within the chamber of another shell 204 once inserted fully within the chamber (which may involve only a portion of the shell 204 to be received within a chamber of another shell 204). A just one example, each nose 216 may include a fuse 220 that is received by and secured a slot defined by the chamber of another shell 204. This allows the shells 204 to be locked in engagement with one another within the cavity 202. This engagement may be reversed to disengage the shells 204 from one another as discussed in greater detail below.

Each shell 204 may include a resistance brake 222 that engages with and/or otherwise interacts with the interior wall of the cavity 202 so as to slow the shell 204 and secure the shell 204 at a position after the shell 204 and/or other shells 204 have been loaded into the cavity 202. Resistance brake 222 may be a friction brake, magnetic brake, an/or other mechanism that may secure the shell 204 at a particular position in the absence of external forces, such as those applied by insertion tool 212 and/or a removal tool 224.

Removal tool 224 may be shaped to have a nose and/or fuse 226 that is sized and shaped to match that of each shell 204. A user may grasp a handle of the removal tool 242 and push the nose and/or fuse 226 into the cavity 202 and into the chamber of the nearest shell 204. The fuse 226 may be secured by the slot of the shell 204 and then the removal tool 222 may be used to push the shell(s) 204 out of the barrel and/or pulled out of the breach. Typically, the extraction process is done after a set number of rounds have been loaded into the cavity 202, and oftentimes all of the shells are extracted in a single motion, although in some embodiments only a single round may be extracted at a single time such that multiple extraction motions must be completed to remove all of the shells 204 from within the cavity 202. In embodiments in which all of the shells 204 are removed in a single action, several weapon loading and dry firing procedures may be performed at a single time, with only one short extraction procedure being necessary to reset the drill. This minimizing training time and eliminates as many false drills associated with dry weapon firing training as possible.

In some embodiments, rather than, or in addition to, incorporating a vented barrel plug (either by using a solid barrel plug or by using no barrel plug, such as in barrel-less applications) the shells 204 themselves may include vents and/or air release valves. For example, a vent opening and/or valve may be provided through each shell 204 that provides a fluid pathway between the inner chamber of each shell 204 and an outer surface of the shell 204 such that as the shells 204 are loaded into the cavity 202 any air within the cavity 202 may be expelled via the vent openings and/or valves to prevent pressure from building up within the cavity 202.

FIGS. 3A-3D depict one embodiment of a weapon firing instrument 300 having a cavity 302 that is configured to receive a number of shells 304 during dry firing exercises. Weapon firing instrument 300 and cavity 302 may be the same as or similar to those described above. For example, the cavity 302 may define a breach and/or barrel of the weapon firing instrument 300 and may include a barrel plug (not shown). The shells 304 may be the same or similar to those described above. For example, each of the shells 304 may include a nose 306 and a body 308 that defines an internal chamber 322 that is configured to receive at least a portion of the nose 306 and/or body 308 of another shell 304 such that any number of shells 304 may be at least partially nested within one another.

Each of the simulated shells 304 includes a resistance brake 310 that is configured to generate friction or other resistance between the simulated shell 304 and the inner wall of the cavity 302. In some embodiments, the resistance brake 310 may include and/or be formed from a motion-resistant medium or material (e.g., rubber, velvet, felt, moleskin, etc.) a marrying profile of notches in groups, magnetic techniques, other friction or resistance generating mechanisms, and/or combinations thereof. As illustrated in the present embodiment, the resistance brake 310 is a friction brake formed from a motion-resistant material. The resistance brake 310 is coupled with an interlock cam 312 that is used to control the force of the resistance brake 310 and, if required, allow the shell 304*a* to provide an engagement with another shell 304*b* that is inserted within the first shell 304*a*. The interlock cam 312 may be an arbitrarily-shaped member to suit the interlock profile requirement. The simulated shell 304*a* may also include a pivot point 314 that is coupled with the resistance brake 310 and the interlock cam 312. The pivot point 314 acts as a fulcrum that can be variably positioned between the resistance brake 310 and the interlock cam 312 at a ratio tailored to suit the requirements of a particular application (design needs, governing or otherwise applicable specification).

The resistance brake 310 and/or the interlock cam 312 may utilize compression and/or tension forces to passively and/or actively control the interlock and resistance of the simulated shells 304. The forces may be delivered by mechanical springs, pneumatic techniques, magnetic techniques, other compression and/or tension mechanisms, and/or combinations thereof. For example, a spring force (or other force) may be used to bias the resistance brake 310 in an outward direction to maximize force applied by the resistance brake 310 when in a default position and/or may bias the interlock cam 312 toward an engagement position in which the interlock cam 312 provides a greatest amount of inward locking force when in a default position. To achieve such results, a spring or other biasing member may be positioned on a resistance brake side and/or an interlock cam side of the pivot point 314 to push, pull, and/or other bias the resistance brake 310 and/or interlock cam 312 into a desired default position. The simulated shells 304 may have an interlock profile that allows a subsequently inserted shell 304*b* to become engaged with the previously inserted shell 304*a* and may be of an arbitrary shape to suit the interlock cam 312. While illustrated as having a curved, tapered distal end, interlock cam 312 may have any other shape that facilitates the locking and subsequent disengagement of different shells 304 to one another using the interlock profile.

For example, the interlock profile may have a lead in portion 316 and a lead out portion 318 to provide variability in the force applied to the resistance brake 304 to assist with the insertion and removal of simulated shells 304. The lead in portion 316 may be sloped such that when shell 304*b* is inserted within shell 304*a*, the lead in portion 316 contacts a portion of the interlock cam 312 of shell 304*a* and displaces the interlock cam 312, thereby rotating the resistance brake 310 about the pivot point 314 and out of engagement with the inner wall of the cavity 302. Upon stopping the insertion of shell 304*b*, the interlock cam 312 may settle in and be secured within a detent 320 formed between the lead in portion 316 and the lead out portion 318. The lead out portion 318 may be sloped in an opposite direction such that when the shell 304*b* is removed, a portion of the interlock cam 312 contacts the lead out portion 318 and is displaced, thereby rotating the resistance brake 310 about the pivot point 314. This reduces or eliminates the braking force of the resistance brake 310 and allows the shell(s) 304 to be pulled out of the cavity 302.

The lead in portion 316 and lead out portion 318 are typically sloped toward a center of the detent 320 such that they form obtuse angles with a base of the detent 320 (or portion thereof). This allows the interlock cam 312 of the shell 304*a* to be more easily removed from the detent 320 of shell 304*b* once the shells 304 are removed from the cavity 302. The exact angle of the lead in portion 316 and/or the lead out portion 318 may be based on a number of factors. For example, the angle may be selected to be slight enough that disengagement of the interlock cam 312 of shell 304*a* from the detent 320 of shell 304*b* is sufficiently easy once removed from cavity 302, while ensuring that the angle is severe enough that the interlock cam 312 of shell 304*a* will not disengage from the detent 320 of shell 304*b* while the shells 304 are still within the cavity 302. Such a design ensures that the interlocked shells 304 may all be removed from the cavity 302 in a single action. In some embodiments, the angle formed between the detent 320 and the lead in portion 316 and/or lead out portion 318 may be between about 110° and 160°, with angles of between about 125° and 145° being more common. It will be appreciated that the angle between the lead in portion 316 and detent 320 and the angle between the lead out portion 318 are not only in opposite directions, but may also have different magnitudes from one another.

It will be appreciated that other designs of interlock profiles may be utilized. For example, while shown with detent 320, lead in portion 316, and lead out portion 318 as being straight segments, it will be appreciated that one or more sections may have curved and/or tapered surfaces. In some embodiments, the detent 320, lead in portion 316, and lead out portion 318 may have a continuous curvature that forms an arc-shaped interlock profile (which may have a constant and/or varying curvature) that makes it difficult or impossible to discern where the lead in/lead out portions 316, 318 end and the detent 320 begins.

While FIGS. 3A-3D show only a single resistance brake 310 on a portion of shell 304*a*, it will be appreciated that any number, shape, and/or arrangement of brakes may be positioned about an outer periphery of each shell 304. For example, a single resistance brake 310 may be positioned at one location on the shell 304 or numerous resistance brakes 310 may be spaced at equal and/or irregular intervals about the outer periphery of the shell 304. The number, size, and/or arrangement of resistance brakes 310 may be selected based on a desired braking force. Based on this braking force and the material and type of resistance brake 310 used, a total surface area of contact between the resistance brake(s) 310 and the inner wall of the cavity 302 may be calculated. For example, when using higher friction motion resistant material (or higher force inducing elements of other types such as magnets) a lower contact area is needed. This allows the number and/or size of resistance brakes 310 to be reduced. It will further be appreciated that in some embodiments, each resistance brake 310 may or may not include its own interlock cam 312 and/or other disengagement mechanism. For example, in some embodiments, one interlock cam 312 and/or other disengagement mechanism may be used to control the engagement of multiple resistance brakes 310.

In some embodiments, the interlock cam 312 (or other mechanism used to secure multiple shells 300 together) may be an independent component from the resistance brake 310.

In such embodiments, the resistance brake 310 may have a different disengagement mechanism that controls the braking force applied by the resistance brake 310, such as a pressure sensor that triggers brake pressure via a solenoid, an sensor coupled with an electromagnetic brake trigger, and/or other mechanism that causes the resistance brake 310 to be selectively engaged and/or disengaged in desired scenarios. In some embodiments, the interlock cam 312 (or other securement mechanism) can be positioned such that it extends from an outer surface of the shell 304 such that the interlock cam 312 can engage with a slot or detent formed within an interior of the chamber of another shell. In some embodiments, the interlock cam 312 may be positioned on the outer surface and still may be coupled with the resistance bracket 310 such that displacement of the interlock cam 312 controls the force applied by the resistance brake 310.

While disclosed using an interlock cam/detent arrangement, any type of disengageable mating features may be utilized to interlock the nested shells with one another. For example, the engagement of the shells 304 may be maintained using spring-biased ball and detent connections, compression rings (metal, plastic, rubber, etc.) that engage with detents or slots, and/or other disengagable connections.

As illustrated in FIG. 3A, the system may be configured to be in an at rest configuration in which the compression and/or tension force acts upon the resistance brake 310 at its maximum to maintain a position of the simulated shell 310 within the cavity 302 of the weapon 300. In such a configuration, a first shell 304*a* is loaded into the cavity 302, oftentimes by applying force to a butt 308 of the shell 304*a* using an insertion tool, such as a flick rammer described above. Once loaded, the resistance brake 310 is biased against the inner wall of the cavity 302, such as by using spring force. In this default position, the resistance brake 310 applies its maximum amount of resistive force to prevent movement of the shell 304*a*. Also in this position, the interlock cam 312 extends fully inward into the interior chamber 322. As shown here, a second shell 304*b* is partially extending into the chamber 322 but has not yet engaged the interlock cam 312 of shell 304*a*.

As depicted in FIG. 3B, the system may be configured to be in an in motion configuration in which a newly inserted shell 304*b* begins to interact with the interlock cam 312 of the previously inserted shell 304*a*. As the shell 304*b* moves further into the cavity 302 and chamber 322, the interlock cam 312 moves into engagement with the interlock profile such that a distal end of the interlock cam 312 slides down the lead out portion 318, into the detent 320, and contacts the lead in portion 316. As the interlock cam 312 contacts the lead in portion 316, the interlock cam 312 is displaced in an outward direction, which causes the resistance brake 310 to be drawn inward (such as by pivoting an arm or rod coupled between the interlock cam 312 and resistance brake 310 about pivot point 314) and variably reduces its applied braking pressure against the wall of the cavity 302. This disengagement of the resistance brake 310 allows the first shell 304*a* to begin moving deeper within cavity 302 to allow space for the new shell 304*b*. Subsequent shells 304 may be added in a similar fashion, with each subsequent shell 304 causing the interlock cams 312 of each of the previous shells (except the first shell 304*a*) to engage the lead in portion 316 of another shell 304 such that all the interlock cams 312 have been displaced and the respective resistance brakes 310 are disengaged. This allows each of the shells 304 to be moved deeper within the cavity 302 when loading additional shells 304. For example, a portion (such as a detent 320 or other interlock profile) of each newly inserted shell 304*b* will snap onto an interlock cam 312 or otherwise be secured with of the previously inserted shell 304*a*. The new shell 304*b* may engage the interlock cam 312 of the previous shell 304*a*, which allows the resistance brake 310 of the previous shell 304*a* to disengage, thereby allowing the new shell 304*b* to be properly inserted within the cavity 302 of the instrument 300. Then the interlock cam 312 of the previous shell 304*a* may engage with a detent 320 formed within the outer wall of the new shell 304*b* to secure the shells 304 together. This allows for simple and authentic insertion of the shells 304, while also allowing easy removal of the loaded shells 304 upon the completion of a drill or other training activity.

In embodiments in which interlocking shells 304 are used, the system may be configured to be in an engaged configuration as illustrated in FIG. 3C. Here, the interlock cam 312 of the first shell 304*a* is fully engaged within the detent 320 of the second shell 304*b*. For example, after the second shell 304*b* is loaded and no more external force is being exerted the interlock cam 312 of the first shell 304*a* may slide down the sloped surface off the lead in portion 316 of the second shell 304*b* and settle within the detent 320 (although in some embodiments, the interlock cam 312 may be askew from the centerline of the detent 320 and/or positioned partially on the lead in portion 316 or lead out portion 318) to secure the shells 304 together and prevent movement independent of one another. The lowest depth of the interlock profile (at detent 320) can be designed to provide the optimum amount of braking desired by a particular application, from maximum braking, variably through medium braking (e.g., to hold its own weight if used in conjunction with gravitational or external force), to minimum braking. Any number of shells 304 may be secured to one another within a cavity 302 of a particular weapon firing instrument 300.

The system may also be configured to be in an in motion configuration as illustrated in FIG. 3D, which allows the interconnected shells 304 to all be removed from the cavity 302 in a single action. Here, the second shell 304*b* is being removed, which draws the lead out portion 318 of the second shell 304*b* into contact with the distal end of the interlock cam 312 of the previously inserted shell 304*a*. This contact displaces the interlock cam 312 of the first shell 304*a* in an outward direction, which causes the resistance brake 310 to be drawn away from the wall of the cavity 302, thereby reducing and/or eliminating the braking force applied by the resistance brake 310. The contact between the lead out portion 318 of the second shell 304*b* and the distal end of the interlock cam 312 of the previously inserted shell 304*a* then allows the second shell 304*b* to pull the previously inserted shell 304*a* out of the cavity 302. Any number of shells 304 may be pulled out of the cavity 302 in a single action, as pulling on the nearest shell 304 will ultimately cause each of the interlock cams 312 to contact a lead out portion 318 of another shell 304 such that all of the resistance brakes 310 may be disengaged at the same time.

In some embodiments, the removal of the interlocked shells 304 from the cavity 302 may be facilitated by a removal tool (not shown). For example, the removal tool may have a front portion that is sized and/or shaped to match or nearly match the nose 306 of each shell 304. For example, the removal tool may include an interlock profile that includes a lead in portion, lead out portion, and/or detent as described herein. The removal tool may be inserted into the chamber 322 of the most recently inserted shell 304 such that the tool's interlock profile engages the interlock cam 312 of the most recently inserted shell 304. The removal tool may then be drawn out of the cavity 302, which causes the interlock cam 312 of each shell 304 to be displaced outward, reducing the braking force applied by the resistance brakes 310 such that the shells 304 may be removed.

While shown with the shells 304 being removed from the same opening through which they were inserted into the cavity 302, it will be appreciated that in some embodiments the shells 304 may be removed from an exit opening of a barrel of the cavity 302. In such embodiments, the most recently inserted shell 304 may be pushed forward (such as by using a removal tool) such that the lead in portion 316 of the most recently inserted shell 304 contacts the distal end of the interlock cam 312 of another shell 304, thereby displacing the respective interlock cam 312 in an outward direction. This causes the resistance brake 310 to be drawn away from the wall of the cavity 302, thereby reducing and/or eliminating the braking force applied by the resistance brake 310. The contact between the lead in portion 316 of the second shell 304*b* and the distal end of the interlock cam 312 of the previously inserted shell 304*a* then allows the second shell 304*b* to push the previously inserted shell 304*a* out of the cavity 302. Any number of shells 304 may be pushed out of the cavity 302 in a single action, as pushing on the nearest shell 304 will ultimately cause each of the interlock cams 312 to contact a lead in portion 316 of another shell 304 such that all of the resistance brakes 310 may be disengaged at the same time.

Once removed from the cavity 302, the shells 304 may be disengaged from one another so that they may be reused in subsequent drills. This may be done, for example, by a user applying inward force to the braking surface of the resistance brake 310 of the last inserted shell 304. This inward force causes the interlock cam 312 to be drawn outward and out of engagement from the interlock profile of the next shell 304. While the interlock cam 312 is retracted, the last inserted shell 304 may be decoupled from the other shells 304. A similar process may be repeated to decouple each of the remaining interlocked shells 304.

Figure 4:
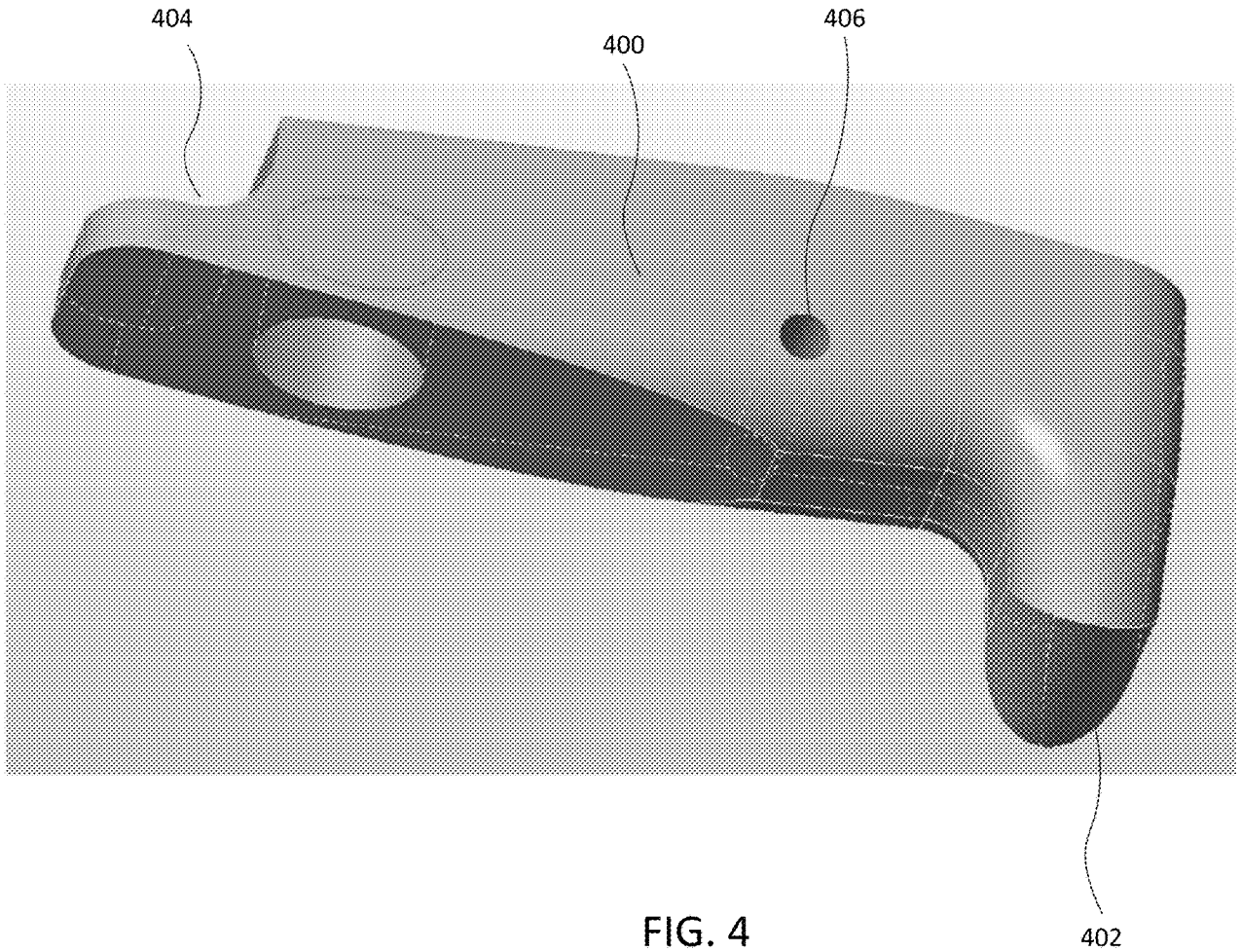
FIG. 4 depicts an interlock cam in accordance with embodiments of the invention.

FIG. 4 depicts one embodiment of a brake interlock cam body 400 according to one embodiment of the invention. Here, cam body 400 includes a cam 402 and a brake seat 404 that is configured to receive and secure a brake pad or other resistance element of a brake. The cam body 400 extends between the cam 402 and the brake seat 404 to form a pivotal lever that allows the contact of the cam 402 to control the relative position of the brake seat 404 (and thus the amount of braking force of the resistance element) as the cam body 400 pivots about a pivot point 406 as desired above. It will be appreciated that cam body 400 is only one embodiment of a cam body and that other designs of cam bodies are possible that allow such actuation between the interlock cam and the resistance brake. Additionally, as discussed elsewhere, in some embodiments, the interlock cam may be designed solely to interconnect multiple shells and may not be tied to the resistance brake.

Figure 5:
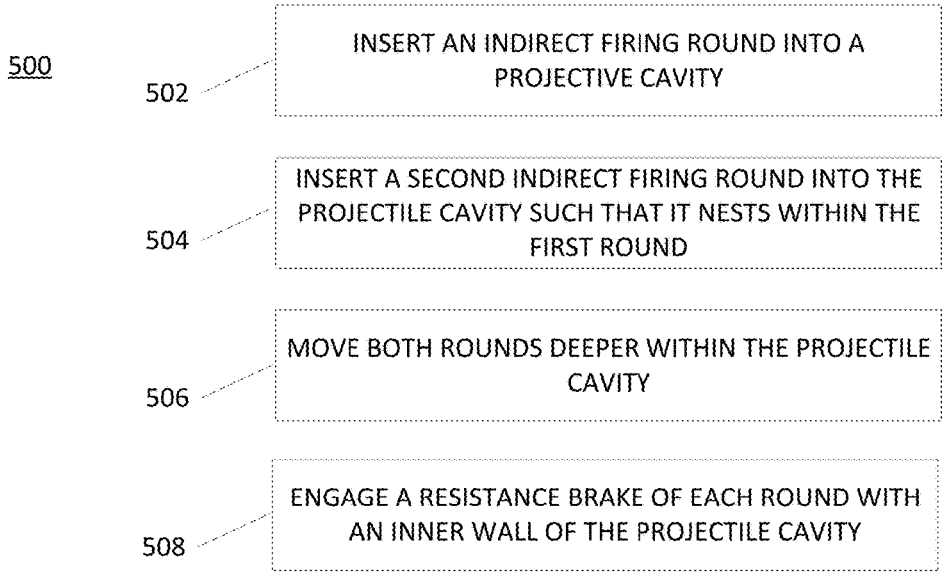
FIG. 5 is a flowchart depicting a process for operating an indirect fire weapon system according to embodiments.

FIG. 5 depicts a process 500 of operating an indirect fire mission training system according to one embodiment. Process 500 may be performed using any of the shells and/or weapon firing instruments described herein. Process 500 may begin at block 502 by inserting a first indirect firing round into a projectile cavity defined within a body of a weapon firing instrument such that a resistance brake of the first indirect firing round engages an inner wall of the projectile cavity and provides resistance that secures the projectile training shell at a position within the projectile cavity. This may be done by a user applying force to a butt end and/or nose of the shell, such as by using an insertion tool that enables the user to apply force in an axial direction relative to the shell. The shell may be sized and shaped and/or include other features that ensure that the insertion force simulates that needed to load a live shell into the projectile cavity.

At block 504, a second indirect firing round is inserted into the projectile cavity such that a distal end of the second indirect firing round nests within an interior chamber of the first indirect firing round and engages an interlock member of the first indirect firing round to disengage the resistance brake of the first indirect firing round. For example, a lead in portion of the second indirect firing round may contact a distal end of the interlock member of the first indirect firing round in an insertion in motion configuration as described in relation to FIG. 3B. This allows both the first indirect firing round and the second indirect firing round to be moved deeper within the projectile cavity at block 506. At block 508, the resistance brake of the first indirect firing round and a resistance brake of the second indirect firing round may be engaged with the inner wall of the cavity. For example, the interlock cam of the first indirect firing round may move to the detent of the second indirect firing round and into an engaged configuration as described in relation to FIG. 3C. This serves to lock both of the shells at their current position while also interconnecting the nested shells.

In some embodiments, as each shell is inserted into the projectile cavity, air may be trapped between the shells and/or an end of the cavity (such as a barrel plug or base of the cavity) and compressed. To prevent this, the air may be vented through the shells and/or the cavity. For example, in some embodiments, air may be vented out of a distal end of the projectile cavity as each indirect firing round is inserted within the projectile cavity. For example, an opening and/or valve may be place in the base and/or barrel plug of the cavity that allows air to be vented in a controlled manner. In some embodiments, the shells themselves may define openings and/or valves that extend through a wall of the shell to connect the interior chamber of the shell with an outer periphery of the shell, providing a fluid pathway through a body of the shell. These pathways may be in a generally longitudinal direction such air from a front of each shell may be fluidly coupled with air from a rear or interior of the shell.

In some embodiments, process 500 may also include removing the shells to reset the indirect firing drill. For example, a removal device may be inserted into an interior chamber of the second indirect firing round to engage an interlock member of the second indirect firing round to disengage the resistance brake of the second indirect firing round. For example, the removal tool may be used to manipulate the shells into the removal in motion configuration as described in relation to FIG. 3D. The process also includes removing the first indirect firing round and the second indirect firing round from the projectile cavity using the removal device. In some embodiments, the first indirect firing round and the second indirect firing round are removed from a proximal end of the projectile cavity through which the first indirect firing round and the second indirect firing round were inserted. Such removal may be done in instruments without barrels and/or those where barrel plugs are used and kept in at all times of a drill. In other embodiments, the first indirect firing round and the second indirect firing round are removed from a distal end (barrel) of the projectile cavity opposite and end through which the first indirect firing round and the second indirect firing round were inserted. Typically, the first indirect firing round and the second indirect firing round are removed in a single action, although in other embodiments only a subset of the shells may be removed at once. Once removed from the cavity, the shells may be disconnected from one another.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure. Furthermore, embodiments of the methods may be implemented by hardware, software, firmware, middleware, microcode, hardware description languages, or any combination thereof. When implemented in software, firmware, middleware, or microcode, the program code or code segments to perform the associated tasks may be stored in a computer-readable medium such as a storage medium. Processors may perform the associated tasks.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. An indirect fire mission training round, comprising:

a projectile training shell having an outer periphery, a proximal end, and a distal end, the proximal end defining an interior chamber, the projectile training shell being configured to be inserted within a cavity of a projectile firing instrument;

an interlock member configured to securely receive a proximal portion of a subsequent training round within the interior chamber of the projectile training shell; and a resistance brake extending outward from the outer periphery and configured to contact a wall of the cavity of the firing instrument and provide resistance that secures the projectile training shell at a position within the cavity, wherein the resistance brake is selectively disengageable such that the position of the projectile training shell is adjustable.

2. The indirect fire mission training round of claim 1, wherein:

the interlock member and the resistance brake are movably coupled with one another such that the when the interlock member is engaged by the subsequent training round, the resistance brake is disengaged and a resistive force applied against the wall of the cavity is reduced.

3. The indirect fire mission training round of claim 1, wherein:

the resistance brake comprises a friction brake.

4. The indirect fire mission training round of claim 1, wherein:

the interlock member is configured to engage with a detent formed in the proximal portion of the of the subsequent training round.

5. The indirect fire mission training round of claim 4, wherein:

the interlock member is movably coupled with the resistance brake such that:

as the interlock member contacts a section of the proximal portion of the subsequent training round that is forward of the detent, the resistance brake is disengaged;

as the interlock member is inserted within the detent, the resistance brake is at least partially reengaged; and as the subsequent training round is removed, the interlock mechanism causes the resistance brake to be disengaged.

6. The indirect fire mission training round of claim 1, wherein:

the proximal end of the projectile training shell defines at least one detent that is configured to securely receive an additional interlock member of an additional training round.

7. The indirect fire mission training round of claim 1, wherein:

the interlock member is coupled with a first side of a proximal end of a rotatable lever and the resistance brake is coupled with a second side of a distal end of the rotatable lever such that when the interlock member is depressed, the resistance brake is drawn inward relative to the projectile training round, and wherein the first side is opposite the second side.

8. An indirect fire mission training system, comprising:

a weapon firing instrument having a body defining a projectile cavity;

a plurality of indirect firing rounds that are configured to be loaded into the projectile cavity in a nested manner, wherein each of the plurality of indirect firing training rounds comprises:

an outer periphery, a proximal end, and a distal end, the proximal end defining an interior chamber;

an interlock member configured to securely receive a proximal portion of a subsequent training round within the interior chamber of the projectile training shell; and a resistance brake extending outward from the outer periphery and configured to contact a wall of the projectile cavity of the weapon firing instrument and provide resistance that secures the projectile training shell at a position within the projectile cavity, wherein the resistance brake is selectively disengageable such that the position of the projectile training shell is adjustable.

9. The indirect fire mission training system of claim 8, further comprising:

a removal device comprising a front portion that is configured to be inserted into the interior chamber of a most proximate one of the plurality of indirect firing rounds to disengage the resistance brake by engaging the interlock mechanism.

10. The indirect fire mission training system of claim 9, wherein:

the removal device comprises a fuse that locks into the interior chamber of the most proximate one of the plurality of indirect firing rounds.

11. The indirect fire mission training system of claim 8, wherein:

a distal end of the body of the weapon firing instrument defines an air vent.

12. The indirect fire mission training system of claim 8, wherein:

a distal end of the body of the weapon firing instrument defines a barrel that is configured to eject a projectile body.

13. The indirect fire mission training system of claim 8, further comprising:

an insertion tool that is configured to load each of the plurality of indirect firing rounds into the projectile cavity.

14. The indirect fire mission training system of claim 8, wherein:

the interlock mechanism is coupled with the resistance brake such that when the subsequent training round is received within the chamber, the interlock mechanism is displaced and causes the brake mechanism to disengage from the wall of the projectile cavity.

15. A method of operating an indirect fire mission training system, comprising:

inserting a first indirect firing round into a projectile cavity defined within a body of a weapon firing instrument such that a resistance brake of the first indirect firing round engages an inner wall of the projectile cavity and provides resistance that secures the projectile training shell at a position within the projectile cavity;

inserting a second indirect firing round into the projectile cavity such that a distal end of the second indirect firing round nests within an interior chamber of the first indirect firing round and engages an interlock member of the first indirect firing round to disengage the resistance brake of the first indirect firing round;

moving both the first indirect firing round and the second indirect firing round deeper within the projectile cavity; and engaging the resistance brake of the first indirect firing round with the inner wall and engaging a resistance brake of the second indirect firing round with the inner wall.

16. The method of operating an indirect fire mission training system of claim 15, further comprising:

inserting a removal device into an interior chamber of the second indirect firing round to engage an interlock member of the second indirect firing round to disengage the resistance brake of the second indirect firing round; and removing the first indirect firing round and the second indirect firing round from the projectile cavity using the removal device.

17. The method of operating an indirect fire mission training system of claim 16, wherein:

the first indirect firing round and the second indirect firing round are removed from a proximal end of the projectile cavity through which the first indirect firing round and the second indirect firing round were inserted.

18. The method of operating an indirect fire mission training system of claim 16, wherein:

the first indirect firing round and the second indirect firing round are removed from a distal end of the projectile cavity opposite and end through which the first indirect firing round and the second indirect firing round were inserted.

19. The method of operating an indirect fire mission training system of claim 16, wherein:

the first indirect firing round and the second indirect firing round are removed in a single action.

20. The method of operating an indirect fire mission training system of claim 15, further comprising:

venting air out of a distal end of the projectile cavity as each indirect firing round is inserted within the projectile cavity.

* * * * *